US010350558B2

(12) United States Patent
Smith et al.

(10) Patent No.: US 10,350,558 B2
(45) Date of Patent: Jul. 16, 2019

(54) ENCLOSED OFFSET PAIL MIXER

(71) Applicants: Jonathan William Smith, Nepean (CA); Matthew William Smith, Algonquin (CA); Hugh Hunter Chant, Lyn (CA)

(72) Inventors: Jonathan William Smith, Nepean (CA); Matthew William Smith, Algonquin (CA); Hugh Hunter Chant, Lyn (CA)

( * ) Notice: Subject to any disclaimer, the term of this patent is extended or adjusted under 35 U.S.C. 154(b) by 121 days.

(21) Appl. No.: 15/590,583

(22) Filed: May 9, 2017

(65) Prior Publication Data

US 2017/0326512 A1 Nov. 16, 2017

Related U.S. Application Data

(60) Provisional application No. 62/334,479, filed on May 11, 2016.

(51) Int. Cl.

| | |
|---|---|
| ***B01F 7/00*** | (2006.01) |
| ***B01F 7/16*** | (2006.01) |
| ***B01F 13/04*** | (2006.01) |
| ***B01F 15/00*** | (2006.01) |
| ***B08B 1/00*** | (2006.01) |
| ***B44D 3/08*** | (2006.01) |

(52) U.S. Cl.

CPC ..... *B01F 7/00225* (2013.01); *B01F 7/161* (2013.01); *B01F 13/047* (2013.01); *B01F 15/00967* (2013.01); *B08B 1/00* (2013.01); *B44D 3/08* (2013.01)

(58) Field of Classification Search

CPC .... B01F 7/00225; B01F 7/161; B01F 13/047; B01F 15/00967; B01F 7/00058; B01F 7/00933; B01F 7/16; B01F 7/1615; B01F 13/045; B01F 7/00008; B01F 7/002; B01F 7/0025; B01F 7/1695; B01F 7/18; B01F 3/0018; B08B 1/00; B44D 3/08; B44D 3/06

USPC ..... 366/197, 200, 201, 203, 206, 207, 239, 366/240, 242, 243, 245, 247, 255, 260

See application file for complete search history.

(56) References Cited

U.S. PATENT DOCUMENTS 4,647,213 A * 3/1987 Hay, II ..... B01F 15/00922 222/108

5,533,805 A * 7/1996 Mandel ..... A47J 36/165 366/197

(Continued)

*Primary Examiner* — William V Gilbert

(57) ABSTRACT

The enclosed offset pail mixer is an invention which allows for safe, efficient and clean mixing of liquid solutions and liquid mechanical mixtures. The mixer includes a moveable head assembly that is constrained to two positions. In the operating position, the mixer geometry substantially encloses the moving parts of the mixer, preventing personnel from coming in contact with moving parts. The geometry also acts to contain dusts and vapors. A safety control circuit ensures that the impeller motor will not operate unless the vessel and the shroud are both in their respective operating position. In the operating position, the impeller shaft axis is strategically offset from the vessel axis to reduce large vortices and associated aeration. When the movable head is in the retracted position, the impeller is positioned over a removable drip cup to prevent residue from dripping on the floor or machine frame.

3 Claims, 1 Drawing Sheet

(56) References Cited

U.S. PATENT DOCUMENTS

Figure 1:
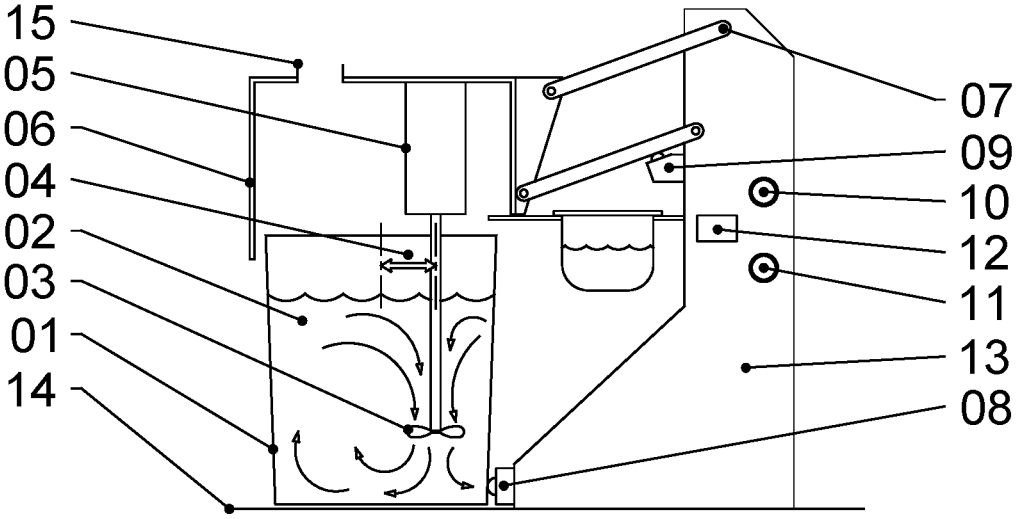

| | | | | |
|---|---|---|---|---|
| 8,920,019 | B2 * | 12/2014 | Kozlowski | A47J 43/042 366/199 |
| 8,960,999 | B1 * | 2/2015 | Ochoa | A47J 43/044 366/207 |
| 9,393,533 | B2 * | 7/2016 | Little | B01F 7/1605 |
| 9,415,358 | B2 * | 8/2016 | Pryor, Jr. | B01F 7/161 |
| 10,052,594 | B2 * | 8/2018 | B R | B01F 3/1221 |
| 2006/0087913 | A1 * | 4/2006 | Leong | B01F 7/161 366/206 |
| 2016/0016133 | A1 * | 1/2016 | Merritt | B01F 7/161 366/242 |
| 2017/0197188 | A1 * | 7/2017 | Gunia | B01F 3/0853 |

* cited by examiner

ENCLOSED OFFSET PAIL MIXER

CROSS-REFERENCE TO RELATED APPLICATION

Not Applicable

BACKGROUND OF INVENTION

This invention pertains to pails or other open-top vessels of various shapes and sizes which contain solutions or mechanical mixtures which are required to be blended. This is a very common need in a wide range of industries which process food products, pharmaceutical products, inks, paints, coatings and general chemical products of many types. There exists a need for a powered mixer which can safely, efficiently and cleanly mix the contents of open-top vessels.

The industry widely relies on an open-impeller type mixer design. This typically comprises a rigidly mounted motor with a spinning shaft and impeller arrangement. This existing technology fails to meet the full performance of the present invention for any or all of the following reasons: Open impeller mixers are unsafe due to the fact that they put the operator in close proximity to exposed, moving mechanical parts, which poses risks of entanglement, cutting or other serious injury or death. Open impeller mixers often align the axis of the impeller assembly at the centerline axis of the vessel, which induces a single, pronounced vortex with sufficient amplitude to allow atmospheric air to reach the impeller and cause aeration of the product being mixed. Open impeller mixers typically require cumbersome manual adjustment at the beginning and end of each batch to raise, lower and otherwise adjust the impeller assembly relative to the vessel. Once the vessel being mixed is removed, open impeller mixers have no provision to prevent residue from dripping from the impeller and shaft. Open impeller mixers typically require the end user to install several separate systems to accommodate the structural support of the mixer and the vessel, to power and control the mixer, to raise and lower the mixer in and out of the vessel, and to evacuate hazardous dusts and vapors created during mixing.

BRIEF SUMMARY OF THE INVENTION

The subject invention is a mechanical mixer for efficiently, safely, and cleanly mixing solutions and mechanical mixtures in open-top vessels. The mixer is a self-contained, stand-alone assembly which encloses the vessel being mixed, supports the motor and impeller assembly, supports all power and control infrastructure, and includes connections for the safe evacuation of hazardous dusts and vapors.

The mixer uses a four-bar linkage design that allows the mixing head to be quickly and easily moved between the retracted position and the operating position. In the operating position, the impeller is engaged with the media in the vessel at the correct depth for ideal mixing, with the centerline of the impeller and the centerline of the vessel offset sufficiently to create a cancelling effect on the vortex induced by the rotating mixing action. Further, in the operating position, the mixer head and frame contain the vessel with minimal openings, allowing it to act as an enclosed guard to prevent personnel from coming in contact with the spinning impeller assembly. In the retracted position, the impeller assembly is positioned directly over a removable drip cup which captures any residue released from the impeller assembly after each mixing operation. The frame of the mixer surrounds the vessel sufficiently during operation to act as a ventilation shroud. Integrated ventilation connection points allow the end user to connect the mixer apparatus to a ventilation system for the safe evacuation of hazardous dusts and vapors.

BRIEF DESCRIPTION OF DRAWING VIEWS

FIG. 1: APPARATUS SECTION VIEW IN OPERATING POSITION (Cross sectional representation of the Enclosed Offset Pail Mixer while retracted)

Figure 2:
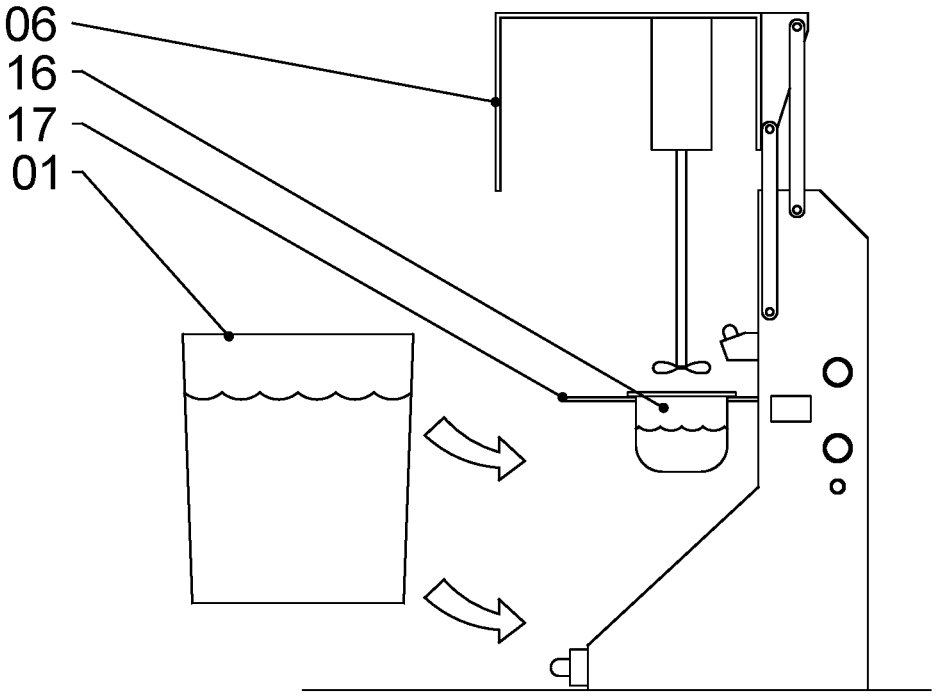

FIG. 2: APPARATUS SECTION VIEW IN RETRACTED POSITION (Cross sectional representation of the Enclosed Offset Pail Mixer while operating)

DETAILED DESCRIPTION OF THE INVENTION

Referring now in detail to FIG. 1 (apparatus section view in operating position), numbered features are described as follows: 1 is an open-top vessel. 2 is a volume of liquid solution or liquid mechanical mixture contained within the open-top vessel. 3 is an impeller and shaft assembly which rotates causing the volume of liquid to be mixed. 4 represents the impeller and shaft offset from the centerline of the vessel to promote random and irregular mixing of the volume of liquid without creating a single large vortex, and to reduce ingress of atmospheric air into the mixture. 5 is motor which imparts rotational speed and torque to the impeller and shaft assembly. 6 is a shroud which supports the rotor assembly and substantially encloses the volume around the vessel during mixing, preventing personnel from contacting moving parts and acting to contain dusts and vapors. 7 is a linkage arrangement which constrains the motion of the head relative to the rigid frame such that the axis of the impeller shaft and the axis of the open-top vessel are offset properly when the head is in the operating position, and such that the axis of the impeller shaft is aligned with the removable drip cup when the head is in the retracted position. 8 is a sensor which detects that the open-top vessel is in operating position. 9 is a sensor which detects that the shroud is fully lowered in the operating position. 10 is a start button to initiate motor rotation. 11 is a stop button to stop rotation of the motor. 12 is a controller which interrupts the motor's energy source IF the pail sensor detects that the pail is absent OR the head position sensor detects that the head is not fully lowered OR the stop button is pressed. 13 is a sturdy frame to which all of the system's components are mounted. 14 is a level floor or stand for supporting the entire apparatus. 15 is an exhaust port for connecting to an external evacuation system for removing dust or vapor which may be created during mixing.

Referring now in detail to FIG. 2 (apparatus section view in retracted position), numbered features are described as follows: 1 is the open-top vessel being introduced to its operating position. 6 is the shroud in the retracted position. 16 is a replaceable drip cup to catch media which may drip from the impeller and shaft assembly. 17 is an integrated drip tray which supports the drip container and extends over the perimeter of the opening of the vessel to prevent media from dripping on the floor while the head subassembly is traversing and/or pivoting between the operating position and the retracted position.

The apparatus can be constructed with varying geometry to accommodate vessels of different shapes and sizes. The apparatus can be made to operate using a motor powered by either electrical energy, or compressed air energy, or hydraulic fluid energy.

The materials of construction of the apparatus are not restricted, provided that they are structurally sturdy enough to perform as intended, and compatible with their environment.

The invention claimed is:

1. An enclosed offset open-top vessel mixer comprising:
a frame;
and a linkaqe arrangement; and
a movable head assembly comprising:
a shroud; and
an exhaust port; and
a motor; and
an impeller and shaft assembly; and
a controls circuit comprising:
a start button; and
a stop button; and
a vessel position sensor; and
a shroud position sensor; and
a controller; and
a drip tray; and
a removable drip cup; and
an open-top vessel; and
a volume of liquid;
wherein the frame is configured to mount on a level floor; and
the frame acts as a rigid connection point for the linkage arrangement; and
the linkage arrangement physically supports the moveable head assembly; and
the linkage arrangement constrains the motion of the moveable head assembly; and
the exhaust port is a penetration through the shroud; and
the motor mounts to the shroud; and
the impeller and shaft assembly mounts to the motor; and
constrained motion of the moveable head assembly is configured to positon the impeller and shaft assembly to an operating position in which a centerline of the impeller and shaft assembly is offset from a center of the vessel; and
the constrained motion of the moveable head assembly positions the impeller and shaft assembly to a retracted position in which the impeller and shaft assembly is directly above the removable drip cup; and
the start button and stop button are mount on the frame; and
the vessel position sensor is mounted on the frame; and
the shroud position sensor mounted on the frame; and
the controller is mounted on the frame; and
the controller is interconnected with the stop button, the vessel position sensor and the shroud position sensor; and
the drip tray is supported on the frame; and the removable drip cup is supported by the drip tray; and
the open-top vessel locates in front of the frame such that the drip tray overhangs the open-top vessel.

2. The enclosed offset open-top vessel mixer of claim 1, wherein the shroud acts to enclose the open-top vessel to prevent personnel from accessing the impeller and shaft assembly while the movable head assembly is in an operating position and the shroud acts as a dust and vapor containment boundary and the exhaust port can be used as an evacuation point to remove dust or vapor generated during operation of the mixer.

3. The enclosed offset open-top vessel mixer of claim 1, wherein the controller sends power to the motor when the start button is momentarily pressed and thereafter fire controller continues to provide power to the motor until the vessel position sensor detects the absence of the vessel, OR until the shroud position sensor detects that the head is NOT in an operating position, OR until the stop button is pressed.

* * * * *